United States Patent [19]

Schrott

[11] 4,371,991

[45] Feb. 8, 1983

[54] CLEAN-OUT TOOL FOR SINKS AND THE LIKE

[76] Inventor: Steve Schrott, 3269 Blue Rock Rd., Cincinnati, Ohio 45239

[21] Appl. No.: 58,515

[22] Filed: Jul. 18, 1979

[51] Int. Cl.[3] ..... F16K 9/00

[52] U.S. Cl. ..... 4/255; 137/247.51

[58] Field of Search ..... 4/166, 187 R, 211, 218, 4/191, 255–257, 306, 310, 420, 427, DIG. 14; 15/104.3 SN, 104.3 R; 285/121, 122, 124, 156, 181; 138/92; 210/310, 447; 137/247.51; D23/46

[56] References Cited

U.S. PATENT DOCUMENTS

| | | | |
|---|---|---|---|
| D. 24,350 | 5/1895 | King | D23/46 |
| 262,549 | 8/1882 | Wortlen | 137/247.51 |
| 844,020 | 2/1907 | Hoffman | 285/121 |
| 986,268 | 3/1911 | Colina et al. | 15/104.3 SN |
| 2,039,467 | 5/1936 | Walsh | 4/255 |
| 2,690,232 | 9/1954 | Brem | 4/DIG. 14 |
| 2,798,504 | 7/1957 | Gast | 285/121 X |
| 3,276,795 | 10/1966 | Heygate | 285/181 |
| 3,872,521 | 3/1975 | Friedman | 15/104.3 SN X |
| 4,031,914 | 6/1977 | Neri | 4/DIG. 14 |
| 4,164,048 | 8/1979 | Kampfer et al. | 4/DIG. 14 |

FOREIGN PATENT DOCUMENTS

| | | | |
|---|---|---|---|
| 193165 | 12/1907 | Fed. Rep. of Germany | 285/121 |
| 2843306 | 4/1979 | Fed. Rep. of Germany | 4/292 |
| 4147 | of 1898 | United Kingdom | 4/257 |

*Primary Examiner*—Charles E. Phillips
*Attorney, Agent, or Firm*—Frost & Jacobs

[57] ABSTRACT

A clean-out tool for sinks and the like having a J-trap section attachable between the sink tail piece and the waste drain outlet, and an extension member attached to the lowermost portion of the trap and extending upwardly to an open end above the overflow level of the sink into which a plumber's snake may be inserted to clear a clog in the waste line. The extension member may be permanently attached to the trap, or may be slip fitted into a branch member extending outwardly from and positioned co-axially with the lowermost part of the arcuate portion of the trap to permit a single extension member to be used with a variety of different traps.

6 Claims, 4 Drawing Figures

CLEAN-OUT TOOL FOR SINKS AND THE LIKE

SUMMARY OF THE INVENTION

Various arrangements have been proposed for gaining access to waste drain lines in order to remove clogs and other stoppages by means of a plumber's snake or the like. Typically, the trap associated with a sink or the like is removed from the waste line, and the snake passed into the line to clear the clog. In some situations, however, particularly in industrial or institutional facilities, the clog may be located at a substantial distance from the waste line opening. Since the snake operator has no way of determining the exact position of the clog, often the entire length of the plumber's snake must be fed through the waste line to be certain the clog has been reached. Often when the snake is removed, all or a portion of the clogging material may remain in the waste line leading to an immediate or eventual clog. Furthermore, as the plumber's snake is withdrawn, considerable amounts of unsanitary waste material may be expelled from the waste line.

In many situations, the entire removal of the sink trap may be difficult and time consuming. While it has been proposed to provide clean-out openings in the sink trap itself, these usually take the form of threaded plugs attached to the lowermost bend of the trap which are useful only for draining the sink or trap, and are not designed to accept a plumber's snake for removing clogs from the waste line. A specific arrangement for allowing plumber's snake access to the trap region is described in U.S. Pat. No. 4,031,914 issued June 28, 1977 to J. E. Neri. In this design, a typical J-trap is provided with an upwardly extending branch which projects obliquely from the vertical leg of the trap. The snake may be inserted through the branch and directed around the arcuate portion of the trap to clear the waste line. However, since the snake must bend through an angle of greater than 90°, difficulty may be encountered in feeding the snake through the waste line, particularly if further bends occur beyond the sink trap as is common in many plumbing installations.

The clean-out tool of the present invention overcomes many of the difficulties of prior art clean-out techniques by providing a conventionally shaped J, P, or S trap section with a straight tubular branch member extending horizontally outwardly and positioned substantially coaxially with the lowermost part of the arcuate portion of the trap. This construction permits a snake to be fed directly into the trap and minimizes the sharp bends which must be negotiated. In one embodiment, the open end of the branch member may be closed by a threaded cap.

In another embodiment, the open end of the branch member is configured to slidingly accept an upwardly directed tubular extension member having an upper open end lying at or slightly above the overflow or flood rim of the associated sink. This arrangement permits the snake operator to easily feed the snake downwardly through the extension member and into the sink trap. Since the open end of the extension is above the overflow level of the sink, the sink may be filled with water while the cleaning operation is in progress. This not only gives an indication of when the clog has been breached since the water level in the sink will fall, but also provides a washing action to flush the clogging material away and clean the outer surface of the snake.

In further modifications of the present invention, the extension member may be permanently attached to the trap section, or may be easily removable therefrom. Furthermore, the extension member may be provided with an angled swivel joint so that it may be maneuvered by the operator to the most convenient position for cleaning. Other features of the invention will become apparent from the detailed description which follows.

DETAILED DESCRIPTION

Figures 1, 4:
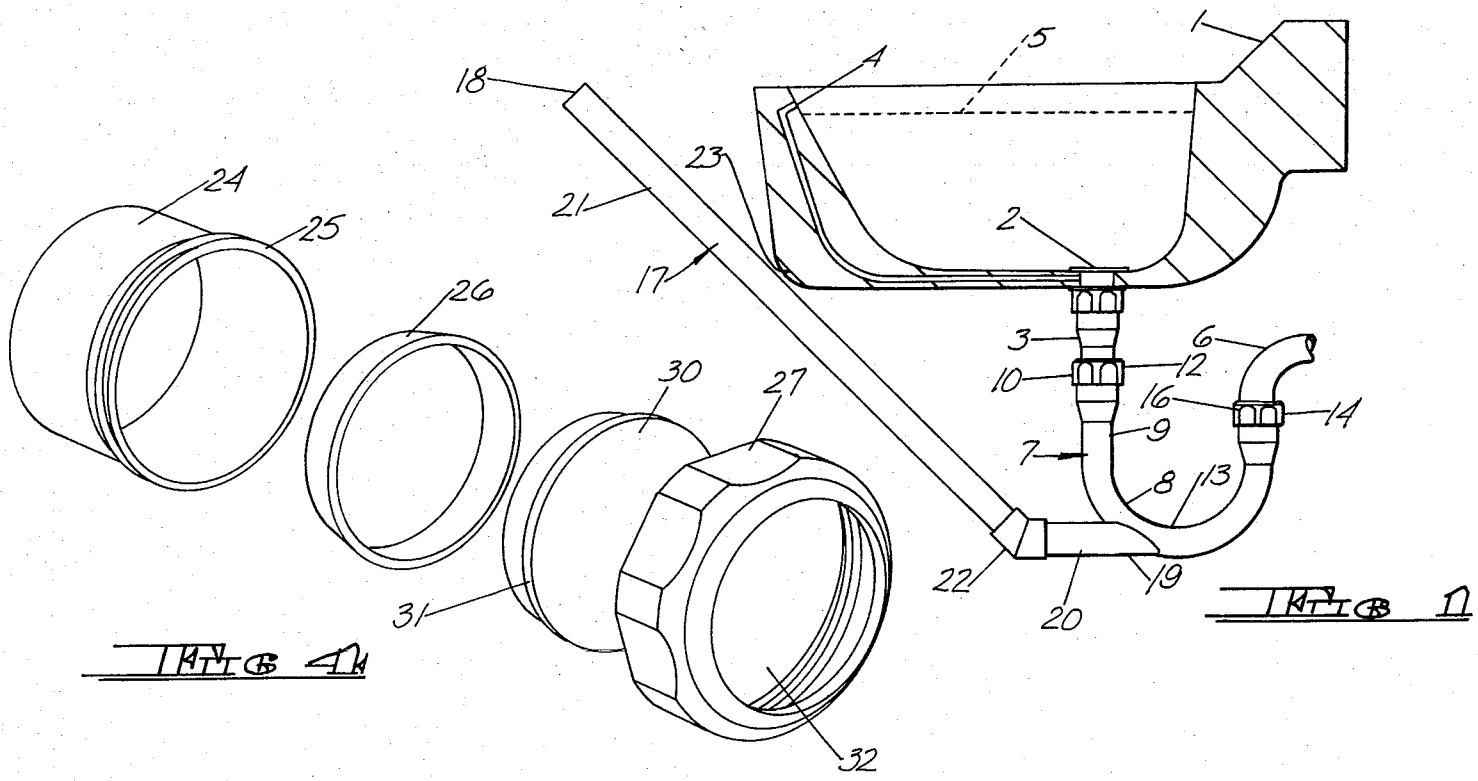
FIG. 1 is a fragmentary cross sectional view of a typical sink utilizing a first embodiment of the clean-out tool of the present invention.
FIG. 4 is a fragmentary exploded enlarged view of the closing means for the branch member of the clean-out tool of the present invention.

FIG. 1 illustrates a typical sink arrangement 1 having a waste drain 2 connected to a downwardly depending sink tail piece 3. Sink 1 also includes an overflow drain 4 which determines the overflow or flood level, indicated generally by dashed line 5, of sink 1.

In conventional installations, a P, S, or J trap (not shown) connects sink tail piece 3 to a suitable waste drain outlet line 6. As illustrated in FIG. 1, the clean-out tool of the present invention, indicated generally at 7 replaces the conventional trap. Although for purposes of an exemplary showing, the present invention has been described and illustrated to replace a conventional J trap, it will be understood that suitable modifications may be made by those skilled in the art to replace traps of the P or S variety. Furthermore, the clean-out tool 7 of the present invention may be sized as desired to accommodate various standard sizes of plumbing installations.

Figure 2:
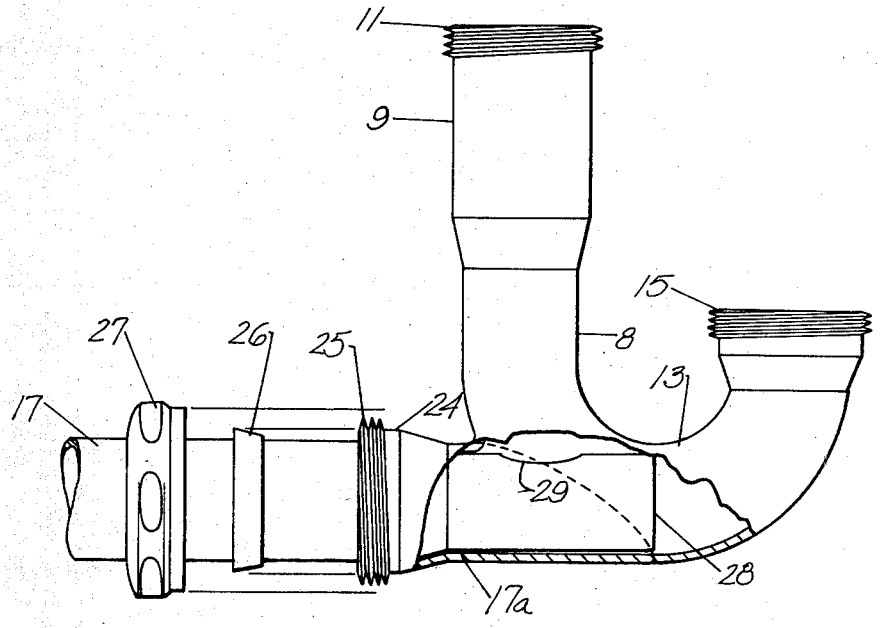
FIG. 2 is an exploded fragmentary side elevation view, partially cutaway and in cross section, of a second embodiment of the clean-out tool of the present invention.
Figure 3:
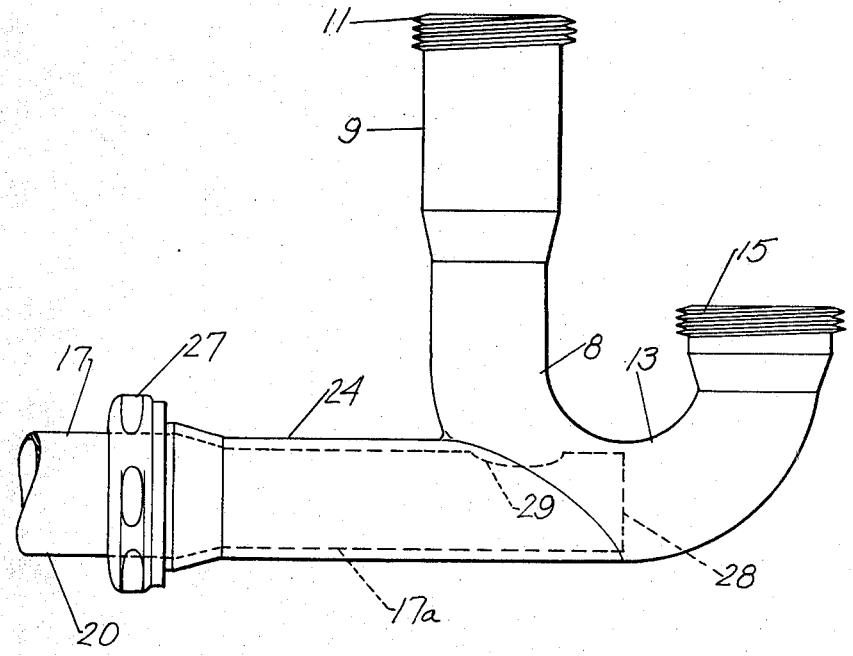
FIG. 3 is a fragmentary side elevation view of a third embodiment of the clean-out tool of the present invention.

Fundamentally, clean-out tool 7 comprises a trap 8, which for purposes of an exemplary showing closely resembles a conventional J trap, having a vertical leg section 9. The upper end of leg section 9 is provided with means 10 for connecting the trap to the lower end of sink tail piece 3. The upper end of vertical leg 9 may be threaded as shown in FIG. 2 and FIG. 3 at 11 to accept a conventional annular nut 12 and washer (not shown) to complete a slip-joint connection as is well understood in the art.

An arcuate portion 13 is attached to the lower end of vertical leg section 9 to form a generally U-shaped trap section. It will be understood that the specific configuration of this trap section may be varied as required to fit individual plumbing installations. The distal end of arcuate portion 13 terminates in means 14 for connecting the trap section to waste drain outlet 6. For example, the distal end of arcuate portion 13 may terminate in a threaded portion 15 which cooperates with a conventional annular nut 16 and washer (not shown), to complete a slip-joint connection with waste drain outlet line 6.

As described hereinbefore, the present invention is directed to an improvement for providing clean-out means for introducing a plumber's snake into the trap in order to reach a clog in the waste drain outlet line 6. In the embodiment of FIG. 1, the clean-out means comprises an upwardly extending tubular extension member, shown generally at 17 having an open upper end 18 configured and dimensioned to receive a conventional plumber's snake (not shown). The lower end 19 of extension member 17 extends outwardly from and communicates substantially co-axially with the lowermost part of arcuate portion 13 of the trap section. In other words, a snake introduced into the trap section through the lower end 19 of extension member 17 will enter the lowermost part of arcuate portion 13 substantially horizontally in order to minimize the amount of bends the snake must negotiate. This is different from conventional arrangements such as that described in aforementioned U.S. Pat. No. 4,031,914, where the snake must undergo a bend of substantially greater than 90° before reaching the waste drain outlet 6.

An important feature of the present invention is that extension member 18 is dimensioned so that upper end 18 extends at least to, and preferably above the overflow level 5 of sink 1. In this manner, sink 1 may be filled with water nearly to overflow opening 4, and the snake introduced into extension member 17 to clear the clog in waste line 6, with the water held in sink 1 acting to flush the clog from the waste line as well as clean the snake as it is removed from clean-out tool 7.

As illustrated in FIG. 1, extension member 17 comprises a substantially straight horizontal tubular lower leg section 20 terminating in lower end 19, a substantially straight tubular upper portion 21 extending angularly upwardly from the lower portion, and elbow means 22 connecting the upper and lower extension member portions. Elbow means 22 may be a conventional rigid elbow connecting member to provide a substantially unitary extension member 17. Alternatively, elbow means 22 may comprise a swivel coupling or connection to permit relative rotational movement between the upper and lower extension member portions. Finally, elbow means 22 may be eliminated altogether, and extension member 17 constructed from a single unitary piece of tubular stock.

As noted, the upper and lower extension member portions are angularly disposed with respect to each other in order to provide minimal bending of the plumber's snake. It has been found that minimal interference with the snake is produced when the angle between the upper and lower extension member portions is no less than 135°. With this constraint, the length of lower extension member portion 20 will be adjusted so that upper extension member portion 21 adequately clears edge 23 of sink 1.

The embodiments of FIG. 2 and FIG. 3 provide means whereby extension member 17 may be removed from trap 8, and only utilized when clean-out of the waste line 6 is required. In these embodiments, similar elements corresponding to elements described in connection with FIG. 1 have been designated similarly. In the embodiments of FIG. 2 and FIG. 3, coupling nuts 10 and 14, together with their associated washers, have been removed for clarity.

In the embodiment of FIG. 2, a substantially straight tubular branch member 24 extends horizontally outwardly from and is positioned substantially co-axially with the lowermost part of arcuate portion 13. In this embodiment, branch member 24 is made as short as possible so as not to extend appreciably beyond trap 8. Means terminate the open end of branch member 24 for attaching extension member 17 thereto, and comprise a threaded portion 25, annular beveled washer 26, and annular coupling nut 27. A clean-out extension member 17, similar to that illustrated in connection with the embodiment of FIG. 1, is slip-fitted into branch member 24, and held in place by means of coupling nut 27 which threadedly engages threads 25. The lower end **17*a* of extension member 17 may be dimensioned to fit partway into branch member 24. However, in the preferred embodiment illustrated in FIG. 2, the lower end 17*a* is dimensioned to extend beyond vertical leg section 9 as at 28 in order to strengthen the mechanical connection between the extension member and the trap 8. In order to permit flow from vertical leg section 9 to arcuate portion 13, an aperture 29 may be provided in the upper wall of lower end 17*a*, and so positioned as to underlie the opening in vertical leg section 9 when extension member 17 is in place as illustrated in FIG. 2. It will be understood that extension member 17 may be fabricated as described hereinbefore in connection with the embodiment of FIG. 1, and will include an upper end 18 which extends at least to, and preferably above the flood level 5 of sink 1**.

As illustrated in FIG. 4, clean-out tool 7 may be provided with means cooperating with the extension member attaching means for closing the open end of branch member 24 when extension member 17 is removed from trap 8. In particular, the closing means comprises a disc-like plate 30 having an annular ridge 31 which is positioned between annular washer 26 and coupling nut 27 to effectively seal opening 32 in nut 27. Alternatively, the aperture 32 in coupling nut 27 may be eliminated to effectively close the opening in branch member 24, although this configuration would necessitate the operator supplying a separate coupling nut 27 having the proper configuration for securing extension member 17 to trap 8.

In the embodiment of FIG. 3, where like elements have been given like designations, branch member 24 has been lengthened, thereby reducing the length of the lower part 20 of extension member 17 necessary to permit the upper portion of extension member 17 to clear the edge 23 of sink 1. In all other respects, the embodiment of FIG. 3 is identical to the embodiment of FIG. 2.

In a typical operating environment, such as a hospital, for example, each conventional sink trap would be replaced with the clean-out tool 7 of FIG, 1, or the trap 8 of FIG. 2 or FIG. 3. If the embodiment exemplified in FIG. 2 and FIG. 3 were utilized, the operator would be required to carry only a single extension member 17 to service the various traps. With extension member 17 secured in place, the sink bowl is filled with water to the appropriate level, and the plumber's snake introduced into the extension member, through the trap and into the waste drain lines. When the clog is reached, the water level in the sink will begin to fall, not only giving a visual indication that the clog has been reached, but also serving to flush away the remnants of the clog. The force of the draining water also serves to clean the snake, so that a separate cleaning operation is not necessary. Finally, since the operator works from a level well above the floor, the plumber's snake and associated realing or driving mechanism can be located on a cart or the like, thereby facilitating transport of the cleaning apparatus.

It will be understood that various changes in the details, materials, steps and arrangements of parts, which have been herein described and illustrated in order to explain the nature of the invention, may be made by those skilled in the art within the principal and scope of the invention as expressed in the appended claims.

For example, trap portion 8 of clean-out tool 7 may be constructed in various sizes to accommodate the associated sizes of the tail piece and waste drain lines. However, branch member 24 associated with each of these traps may be fabricated in a standard size so that a single extension member 17 may be used with all traps. It will be further understood while for purposes of an exemplary showing the present invention has been described and illustrated in association with a J-type trap, other types of traps such as those of the S or P variety may be utilized with the appropriate modifications.

The embodiments of the invention in which an exclusive property or privilege is claimed are as follows:

1. In a tubular sink trap having a vertical leg section, means terminating the upper end of said leg section for connecting said trap to the lower end of a sink tail piece depending downwardly from a sink, an arcuate portion attached to the lower end of said leg section to form a generally U-shaped trap section, and means terminating the distal end of said arcuate portion for connecting said trap section to a waste drain outlet, the improvement in combination therewith comprising clean-out means for introducing a plumber's snake into said trap including a substantially straight tubular branch member extending horizontally outwardly from and positioned substantially co-axially with the lowermost part of said arcuate portion, an extension member comprising an upwardly extending tubular pipe having an open upper end configured to receive a plumber's snake, the lower end of the extension member extending substantially co-axially with said branch member, the extension member being dimensioned so that the upper end of the extension member extends at least to the overflow level of the sink, and means terminating the open end of said branch member for attaching the extension member thereto, the lower end of said extension member being slip-fitted within said branch member, the lower end of said extension member extending beyond said vertical leg section and containing an aperture in the upper wall of said lower end to permit flow of waste water from ssid vertical leg section to said arcuate portion.

2. The trap according to claim 1 wherein said extension member comprises a substantially straight horizontal lower leg section terminating in said lower end, a substantially straight upper portion extending angularly upwardly from said lower portion, and elbow means connecting said upper and lower extension member portions.

3. The trap according to claim 2 wherein said elbow means comprises a swivel connection permitting relative rotational movement between said upper and lower extension member portions.

4. The trap according to claim 2 wherein said upper and lower extension member portions are angularly disposed at no less than 135°.

5. The trap according to claim 1 including means cooperating with said extension member attaching means for closing the open end of said branch member when said extension member is removed from said trap.

6. The trap according to claim 5 wherein said closing means comprises a disc-like plate and a coupling nut having a central opening and threadably engaging the open end of said branch member, said disc-like plate being secured between said coupling nut and said open end.

* * * * *